US006899198B2

(12) United States Patent
Zindl et al.

(10) Patent No.: US 6,899,198 B2
(45) Date of Patent: May 31, 2005

(54) COMPRESSED AIR MUFFLER

(75) Inventors: Manfred Zindl, Reutlingen (DE); Yvonne Krehl, Stuttgart (DE); Markus Bretzler, Heubach (DE)

(73) Assignee: Festo AG & Co., Esslingen (DE)

( * ) Notice: Subject to any disclaimer, the term of this patent is extended or adjusted under 35 U.S.C. 154(b) by 131 days.

(21) Appl. No.: 10/395,493

(22) Filed: Mar. 24, 2003

(65) Prior Publication Data

US 2003/0183447 A1 Oct. 2, 2003

(30) Foreign Application Priority Data

Mar. 30, 2002 (DE) ..... 202 05 068 U

(51) Int. Cl.[7] ..... F01N 1/24; F01N 1/10; F04F 5/46

(52) U.S. Cl. ..... 181/222; 181/217; 181/230; 181/252; 181/256; 417/187

(58) Field of Search ..... 181/217, 213, 181/212, 210, 211, 222, 224, 225, 229, 230, 403, 252, 256, 262, 243, 247, 248, 282; 417/174, 163, 151, 76, 187, 148

(56) References Cited

U.S. PATENT DOCUMENTS

| | | | | | |
|---|---|---|---|---|---|
| 822,127 | A | * | 5/1906 | Hufnagel | 181/239 |
| 2,185,584 | A | * | 1/1940 | Boyce | 181/252 |
| 4,227,591 | A | * | 10/1980 | Klaus et al. | 181/230 |
| 4,316,523 | A | * | 2/1982 | Boretti | 181/226 |
| 4,402,651 | A | * | 9/1983 | Ise | 417/187 |
| 4,549,854 | A | * | 10/1985 | Yamamoto | 417/187 |
| 4,655,692 | A | * | 4/1987 | Ise | 417/187 |
| 4,759,691 | A | | 7/1988 | Kroupa | |
| 6,158,546 | A | * | 12/2000 | Hanson et al. | 181/255 |
| 6,220,387 | B1 | * | 4/2001 | Hoppes et al. | 181/259 |

FOREIGN PATENT DOCUMENTS

| | | | | |
|---|---|---|---|---|
| DE | 31 30 292 C1 | | 2/1984 | |
| DE | 34 01 209 A1 | | 7/1985 | |
| DE | 43 03 319 A1 | | 8/1994 | |
| DE | 100 09 164 C1 | | 7/2001 | |
| DE | 100 27 873 C1 | | 7/2002 | |
| FR | 2681905 A1 | * | 4/1993 | F01N/7/00 |
| RU | 2 179 225 | | 2/2002 | |
| WO | WO 00/50776 | | 8/2000 | |

* cited by examiner

*Primary Examiner*—Shih-Yung Hsieh
*Assistant Examiner*—Edgardo San Martin
(74) *Attorney, Agent, or Firm*—Hoffmann & Baron, LLP

(57) ABSTRACT

A compressed air muffler comprises a rear attachment section, a compressed air muffler section adjoining it in the longitudinal direction with a compressed air muffler body of a porous compressed air muffler material and an outlet duct extending in the length direction as far as a front outlet opening, such outlet duct having in the muffler section, a form tapering toward the outlet opening. The muffler body has a bare outer peripheral face, its outer periphery face constituting an outlet face for the compressed air flowing through its wall athwart the longitudinal direction. The duct section extending through the attachment section, of the outlet duct merges steplessly with the duct section running in the muffler section.

11 Claims, 1 Drawing Sheet

COMPRESSED AIR MUFFLER

The application claims priority from Application No. DE 202 05068.8 filed on Mar. 30, 2002.

BACKGROUND OF THE INVENTION

The invention relates to a compressed air muffler comprising a rear attachment section, a muffler section adjoining same in the longitudinal direction, said muffler section having a muffler body of porous muffler material and an outlet duct extending through in the longitudinal direction as far as a front outlet opening, said outlet duct having a form tapering within the muffler section toward the outlet opening.

THE PRIOR ART

A compressed air muffler of this type described in the patent publication WO 00/50776 A1 is employed in conjunction with an ejector means functioning for producing vacuum. At its rear attachment section it is connected to the outlet opening of an ejector means and serves for muffling noise due to compressed air emerging from the receiving nozzle of the ejector means.

At the rear the compressed air muffler possesses an attachment section for securing it to the ejector means, which is adjoined by a muffler section, which possesses a muffler of porous muffler material. In order to minimize soiling of the muffler material an outlet duct is present extending through the compressed air muffler and opening at the front side through an outlet opening into the surroundings. Within the muffler section the outlet duct has a form tapering toward the outlet opening. The muffler body is seated in a sleeve-like housing, by which it is covered at its outer periphery.

This known compressed air muffler does possess the advantage that it soils or clogs up more slowly than a muffler which is shut off in the front portion thereof as well. However, there are disadvantages as regarding muffling efficiency.

SHORT SUMMARY OF THE INVENTION

One object of the invention is accordingly to provide a compressed air muffler of the type initially mentioned, which possesses an enhanced muffling effect.

In order to achieve these and/or other objects appearing from the present specification, claims and drawings, in the present invention the muffler body has a bare or uncovered outer periphery, its outer peripheral face constituting an outlet face for the compressed air flowing through its wall athwart the longitudinal direction, and the duct section extending in the attachment section merges steplessly into the duct section extending in the muffler section.

In contradistinction to the prior art the compressed air can now flow out through the bare outer periphery of the muffler body so that the volumetric flow emerging at the front outlet opening and the noise caused by the free jet are reduced. The stepless shape of the duct has the advantage in this respect that the formation of eddies is prevented, which might prevent or interfere with the passage of the compressed air through the wall of the muffler body. Therefore there is a high muffler efficiency even with a relatively small length.

Advantageous developments of the invention are defined in the claims.

The duct section, extending in the attachment section, of the outlet duct may have a constant cross section and merge steplessly into the suitably designed inlet cross section of the duct section extending in the muffler section. The duct wall may be sightly angled in the transition zone owing to this.

However a design is regarded as being particularly advantageous in the case of which the outlet duct has a taper along its full length toward the outlet opening so that it even tapers in the attachment section. It is in this manner that a particularly effective course of flow is arranged for.

The tapering form is very simple to produce by having a conical shape.

The attachment section may possess an attachment body, which consists of a material different to that of the muffler body, the two bodies being permanently joined together for example by welding or bonding. In the case of a particularly advantageous design the compressed air muffler is an integral component completely fashioned of the porous material. As has been shown, in the case of duct configuration in accordance with the invention the structural load in the longitudinal direction of the compressed air muffler is comparatively low so that even in the case of the above mentioned integral design the necessary strength characteristics are achieved and with them a substantial reduction of the costs of manufacture.

The muffler material can for example be sintered bronze, sintered brass, polyethylene sintered material, sintered stainless steel or some other suitable sintered material.

The muffler body may for example be circularly cylindrical. However, it has turned out to be more particularly advantageous for the muffler body to possess an externally tapering configuration matching that of the outlet duct so that it preferably has a constant wall thickness along its length. Accordingly there is, despite the conical configuration of the outlet duct, in the wall of the muffler body no significant increase of flow resistance toward the outlet opening so that the volumetric flow emerging through the outlet opening and accordingly the noise of the emerging flow are reduced still further.

In conjunction with an ejector means on the inlet side there are particular advantages with the compressed air muffler, if its outlet diameter at the outlet opening is larger than the minimum diameter of the receiving nozzle of the upstream ejector means.

Further advantageous developments and convenient forms of the invention will be understood from the following detailed descriptive disclosure of embodiments thereof in conjunction with the accompanying drawing.

LIST OF THE SEVERAL VIEWS OF THE FIGURES

DETAILED ACCOUNT OF WORKING EMBODIMENTS OF THE INVENTION

Figure 1:
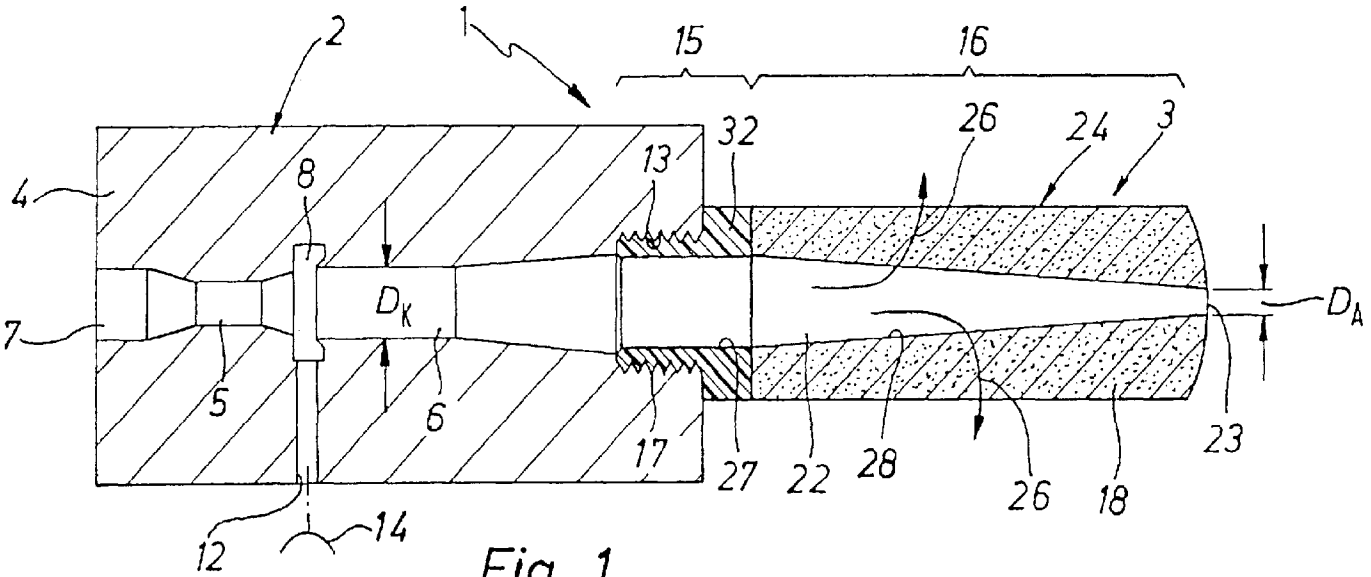
FIG. 1 represents a first design of the compressed air muffler of the invention in a condition installed on an ejector means for vacuum production, all as seen in longitudinal section.

The drawing shows a vacuum producing device generally referenced 1. The device comprising an ejector means 2, which is provided with a compressed air muffler 3 in accordance with the invention.

The ejector means 2 possesses a housing 4, which has or defines a jet nozzle 5 and a receiving nozzle 6 adjoining same. The jet nozzle 5 possesses an inlet opening 7, at which during operation of the vacuum producing device 1 compressed air is supplied at a gage pressure in relation to the atmospheric pressure.

To the rear the receiving nozzle 6 adjoins the jet nozzle 5. Between the outlet opening of the jet nozzle 5 and the inlet opening of the receiving nozzle 6 an intermediate space is located, which defines a draw off space 8, which is connected by way of a duct with a suction or draw off opening 12.

At the rear end, opposite to the inlet opening, the receiving nozzle 6 has an outlet opening 13.

During operation of the arrangement compressed air supplied at the supply opening 7 is accelerated on flowing through the jet nozzle 5 and on entering the receiving nozzle 6 produces vacuum in the suction space 8. Such vacuum causes a draw off effect at the suction opening 12 and at a connected means 14, which is to be evacuated. Such means is for example a suction gripper having a suction cup or as suction plate. Together with the drawn off air the supplied compressed air is let off through the receiving nozzle, which widens toward the outlet opening 13 into the atmosphere.

Owing to the compressed air muffler 3 connected with the outlet opening 13 of the receiving nozzle 6 the noise of the emerging compressed air is reduced to an acceptable level.

The compressed air muffler 3 is an elongated, slim component with a rear attachment section 15 at which it is adjoined by a muffler section 16 in the longitudinal direction. By the intermediary of the attachment section 15 the compressed air muffler 3 is secured adjacent to the outlet opening 13 to the housing 4 of the ejector means 2.

In the case of the working examples the attachment section 15 has an attachment screw thread 17 in the form of a male thread, by means of which it is screwed into a matching female thread at the outlet opening 13. If needed sealing means may be provided, for example in the form of a sealant or of a bonding material.

In the two working embodiments the muffler section 16 consists exclusively of a muffler body 18 of porous muffler material. As a muffler material a sintered material as for example sintered bronze, sintered brass, polyethylene sintered material, sintered stainless steel or some other suitable sintered material is recommended. Fine pores and pores in the nano range of size or interstitial spaces in such material render possible the passage of compressed air given a sufficiently high pressure gradient.

The compressed air muffler 3 has an outlet duct 22 extending through it in the longitudinal direction linearly. At its rear side it opens toward the free end face of the attachment section 15. At its opposite end it opens toward the front side, axially opposite to the attachment section 15, of the muffler body 18, such opening being termed an outlet opening 23.

The outlet duct 22 has, at least within the muffler section 16, a form tapering toward the outlet opening 23. This tapering form preferably is the result of a conically tapering longitudinal configuration. The reduction in cross section is preferably continuous or, respectively, constant.

The muffler body 18 has a bare or uncovered outer periphery. Accordingly its outer peripheral face directed athwart the longitudinal direction constitutes an outlet flow face 24, at which compressed air, flowing more particularly radially through the wall 25 of the muffler body 18 athwart the longitudinal direction, may emerge all the way round (see arrows 26 indicating the flow).

As the compressed air flows through the compressed air muffler 3 part of the compressed air will flow as a free jet from the outlet opening 23, whereas other fractions will flow as indicated by the arrows 26 through the sleeve-like wall 25 and will emerge at the outlet face 24. The outlet face 24 extends along the full length and along the full outer periphery of the muffler body 18.

Owing to the tapering course of the outlet duct 22 back pressure and friction effects occur, which result in there being a tendency of the part of the air to flow through the wall 25 of the muffler body 18. The mass flow emerging at the outlet duct 23 is accordingly smaller than it would be with a constant duct cross section so that there is a reduction in the noise level. In the working embodiment the emerging volumetric flow is particularly small, because the entire outer periphery of the muffler body 18 is available as an outlet face 24. In this case the length of the muffler body 18 may be employed in an optimum fashion, because the first duct section 27 extending in the attachment section 15 steplessly merges with the second duct section 28 extending through the muffler section 16 or, respectively, muffler body 18.

The stepless transition without any step-like widening or narrowing ensures undisturbed flow without any turbulence in the transition area, which might otherwise occur on entry of the compressed air into the wall of the muffler body 18.

In the working embodiment illustrated in FIG. 1 the attachment section 15 is composed of an attachment body 32, which consists of a different material to that of the muffler body 18 permanently connected with it. The attachment body 32 may for example consist of plastic or metal. The permanent connection with the muffler body 18 is for instance produced by a welded join or an adhesive bond. In this respect the muffler body 18 may be mounted at an obtuse angle on the attachment body 32.

In the case of this working example it may be expedient for reasons of manufacturing technology to limit the tapering course of the outlet duct 22 to the second duct section 28 in the muffler body 18. The first duct section 27 extending in the attachment body 32 will in this embodiment as well have a constant cross section from end to end, such cross section matching the inlet or entry cross section of the second duct section 28. As a result in the transition zone there will be only a discontinuity or bend in the outlet duct 22, which will hardly have any disadvantageous effect on the conditions of flow.

Figure 2:
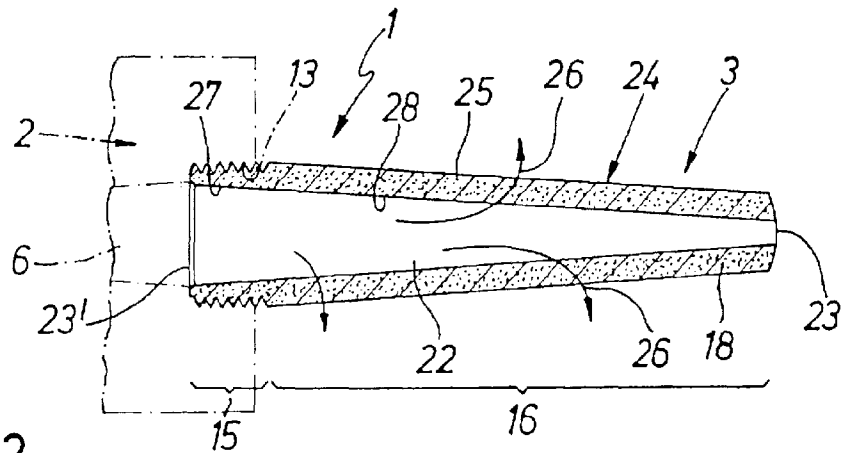
FIG. 2 shows an alternative design of the compressed air muffler in a view similar to that of FIG. 1, the ejector means on the inlet side only being indicated in chained lines and in part.

Nevertheless the design illustrated in FIG. 2 is considered to be the optimum form, in the case of which the tapering duct course extends along the full length of the outlet duct 22. The maximum duct cross section is here best located at the inlet opening 23', which is the end face of the attachment section 15, of the outlet duct 22, whereas the minimum duct cross section is adjacent to the outlet opening 23.

The course, which tapers along the full length, of the outlet duct 22 may to be produced in a particularly advantageous manner, if the compressed air muffler is produced integrally of porous muffler material, as is the case with the working example in accordance with FIG. 2. In this case the attachment section 15 as well consists of the muffler material of the section 16 thereof so that elaborate multi-component manufacturing technology is not necessary.

Compressed air mufflers 3 are in principle suitable for all applications, in the case of which the noise of emerging compressed air is to be reduced. They could for instance be utilized in conjunction with valves or compressed air powered drives. More particularly advantageous are applications in combination with an ejector means 2, there being here the advantageous possibility of optimally adapting the geometry of the compressed air muffler 3 to the design of the ejector means 2.

A particularly satisfactory muffling effect is to be achieved if the outlet diameter $D_A$ at the outlet opening 22 is at a minimum while however at all times being larger than the minimum diameter $D_K$ of the receiving nozzle 6 of the ejector means 2.

The compressed air muffler 3 preferably generally has a rod-like or bar-like form. The cross sectional outline of the outer periphery is preferably circular.

FIG. 1 shows an embodiment of the compressed air muffler 3, in which the muffler body 18 generally has an circularly cylindrical form externally. In conjunction with the tapering outlet duct 22 extending through it, this design leads to a thickness of the wall 25, widening toward the outlet opening 23, of the muffler body 18. The result of this may be that the resistance to flow of the compressed air flowing through the wall 25 will increase toward the front side of the muffler body 18. Accordingly a design is preferred, in which the muffler body 18 externally has a configuration tapering toward the front side matching the outlet duct 22.

Accordingly the wall thickness of the muffler body 18 may also be kept relatively small in the front zone as well. There is more particularly the advantageous possibility of manufacturing the muffler body 18 with a constant wall thickness for its entire length so that in the radial flow through it will be even and optimum efficiency is achieved. Preferably the muffler body 18 will externally have a conically tapering shape.

What is claimed is:

1. A compressed air muffler comprising:

a rear attachment section having a first outlet duct section; and a muffler section adjoining said read attachment section in the longitudinal direction, said muffler section having a muffler body of porous muffler material, a second outlet duct section extending therein in the longitudinal direction and an outlet opening communicating with said second outlet duct, said second outlet duct having a form tapering within the muffler section toward the outlet opening and said muffler body having a bare outer periphery whereby an outer peripheral face of said muffler body forms an outlet face for compressed air flowing therethrough perpendicularly to the longitudinal direction, wherein said first outlet duct section of said rear attachment section merges steplessly with said second outlet duct section of said muffler section, and wherein the first and second outlet duct sections have a tapering form along their combined entire length, such taper being toward the outlet opening.

2. The compressed air muffler as set forth in claim 1, wherein the tapering configuration of the first and second outlet duct sections is conical.

3. The compressed air muffler as set forth in claim 1, wherein said rear attachment section and said muffler are formed integrally of porous muffler material.

4. The compressed air muffler as set forth in claim 1, wherein the attachment section possesses an attachment thread in the form of a male screw thread.

5. The compressed air muffler as set forth in claim 1, wherein the porous material is selected from the group consisting substantially of sintered bronze, sintered brass, polyethylene sintered material, sintered stainless steel.

6. The compressed air muffler as set forth in claim 1, wherein the muffler body has a circularly cylindrical external geometry.

7. The compressed air muffler as set forth in claim 1, wherein the muffler body has an external form tapering to the outlet duct, wherein said muffler body has a constant wall thickness along is length.

8. The compressed air muffler as set forth in claim 7, wherein the muffler body has a conically tapering external form.

9. In combination with a compressed air muffler as set forth in claim 1, an upstream ejector means for generating a vacuum, the outlet diameter at the outlet opening of the outlet duct being of minimum size but larger than the minimum diameter of the receiving nozzle of the ejector means.

10. A compressed air muffler comprising:

a rear attachment section having a first outlet duct section; and a muffler section adjoining said rear attachment section in the longitudinal direction, said muffler section having a muffler body of porous muffler material, a second outlet duct section extending therein in the longitudinal direction and an outlet opening communicating with said second outlet duct, said second outlet duct having a form tapering within the muffler section toward the outlet opening and said muffler body having a bare outer periphery whereby an outer peripheral face of said muffler body forms an outlet face for compressed air flowing therethrough perpendicularly to the longitudinal direction, wherein said first outlet duct section of said rear attachment section merges steplessly with said second outlet duct section of said muffler section, and wherein said muffler body has a circularly cylindrical external geometry.

11. In combination:

a compressed air muffler including a rear attachment section having a first outlet duct section and a muffler section adjoining said rear attachment section in the longitudinal direction, said muffler section having a muffler body of porous muffler material, a second outlet duct section extending therein in the longitudinal direction and an outlet opening communicating with said second outlet duct, said second outlet duct having a form tapering within the muffler section toward the outlet opening and said muffler body having a bare outer periphery whereby an outer peripheral face of said muffler body forms an outlet face for compressed air flowing therethrough perpendicularly to the longitudinal direction, wherein said first outlet duct section of said rear attachment section merges steplessly with said second outlet duct section of said muffler section; and an ejector means for generating a vacuum connected to said compressed air muffler upstream of said muffler in a longitudinal direction, said ejector means having a jet nozzle and a receiving nozzle in fluid communication with said jet nozzle, said first outlet duct section of said muffler rear attachment section being fluidly connected to said receiving nozzle and wherein said outlet opening of said muffler section has a diameter larger than the minimum diameter of said receiving nozzle of said ejector means.

* * * * *

UNITED STATES PATENT AND TRADEMARK OFFICE

CERTIFICATE OF CORRECTION

PATENT NO. : 6,899,198 B2
DATED : May 31, 2005
INVENTOR(S) : Zindl et al.

It is certified that error appears in the above-identified patent and that said Letters Patent is hereby corrected as shown below:

Column 5,
Line 59, now reads “said muffler are” should read -- said muffler section are --.

Signed and Sealed this

Eighth Day of November, 2005

JON W. DUDAS
*Director of the United States Patent and Trademark Office*